US005215711A

United States Patent [19]

Mikawa

[11] Patent Number: 5,215,711

[45] Date of Patent: Jun. 1, 1993

[54] AGE-HARDENING TYPE SPECIAL CU ALLOY

[76] Inventor: Tsuneaki Mikawa, 56-11, Nakadai 1-chome, Itabashi-ku, Japan

[21] Appl. No.: 863,909

[22] Filed: Apr. 6, 1992

[30] Foreign Application Priority Data

Oct. 8, 1991 [JP] Japan ..... 3-287279

[51] Int. Cl.[5] ..... C22C 9/06

[52] U.S. Cl. ..... 420/487; 420/490

[58] Field of Search ..... 420/487, 490; 148/414

[56] References Cited

U.S. PATENT DOCUMENTS 4,732,733 3/1988 Sakamoto et al. ..... 420/487
4,818,307 4/1989 Mori et al. ..... 420/487
5,041,176 8/1991 Mikawa ..... 148/414

FOREIGN PATENT DOCUMENTS 291766 1/1971 U.S.S.R. ..... 420/487

*Primary Examiner*—Deborah Yee
*Attorney, Agent, or Firm*—Armstrong, Westerman, Hattori, McLeland & Naughton

[57] ABSTRACT

An age-hardening type special Cu alloy prepared by compounding 0.1 to 5% by weight of Ni, 0.01 to 7% by weight of Si, 0.01 to 10% by weight of Fe, 0.01 to 7% by weight of Ti and 0.001 to 1% by weight of B in Cu as the main component.

This alloy is improved in the electrical conductivity, heat-conductivity and mechanical properties such as, in particular, the hardness and resiliency compared to the hitherto known alloys, and is useful for electronic parts.

6 Claims, No Drawings

AGE-HARDENING TYPE SPECIAL CU ALLOY

FIELD OF THE INVENTION

The present invention relates to age-hardening type special Cu alloys containing Cu as the main component.

BACKGROUND OF THE INVENTION

Alloys containing Cu as the main component are excellent in the characteristics such as electroconductivity, plating property, soldering property, high strength electric conduction, heat-resistance and the like so that they are used for electronic parts and the like.

The hitherto known Cu alloys used for electronic parts were not necessarily satisfactory in their mechanical properties or, particularly, in the hardness, elasticity (resiliency) and the like.

Alloys of high-strenght type with heat-resistance can be obtained by adding Ni, Si, B and the like to an alloy of Cu, Fe and Ti which is turned into any of intermetallic compounds of Cu or Fe with Ni, B or Ti or into a solid solution based on any of them as the parent body, both having the age-hardening property. Such alloys have an excellent characteristic as exemplified by the function of Cu-Fe-Ti alloy or Cu-Ni-Ti alloy as a heat-resistant electroconduction alloy or by Cu-Si-Ti alloy as heat-strength electric conduction alloy.

That is to say, by adding any of third elements to such an alloy, Fe turns into $Fe_2Ti$ in the case of Cu-Fe-Ti and Ni turns into $Ni_3Ti$ in the case of Cu-Ni-Ti.

Si is provided with the age-hardening property in the form of $Si_3Ti_5$ in the case of Cu-Si-Ti.

The present invention has been made paying attention to the above respects and provides a Cu alloy suitable as the material for electronic parts.

DISCLOSURE OF THE INVENTION

The Cu alloys according to the present invention are prepared by compounding 0.01 to 10% by weight of Fe, 0.01 to 7% by weight of Si, 0.01 to 10% by weight of Ni, 0.01 to 7% by weight of Ti and 0.001 to 1% by weight of B with Cu as the main component.

The characteristic of this alloy markedly vary depending on the contents of Fe, Ni, Si and Ti. Thereby the phenomenon of age-hardening is effected after tempering to bring about improvement of the mechanical properties.

BEST MODE FOR CARRYING OUT THE INVENTION

The inventive age-hardening type special Cu alloy has been developed to meet the object of applying to electronic parts which require strength, hardness, soldering property, plating property, resiliency and the like in addition to high-strength-type electric conduction with heat-resistance.

The age-hardening type special Cu alloy is provided with the excellent characteristics as a heat-resistant and high-strength alloy for electric conduction by adding Ti to a Cu-Fe-Ni-Si alloy to turn into intermetallic compounds thereby imparting the age-hardening property.

The characteristics of this alloy markedly vary depending on the amounts of Cu, Ni, Si and Ti.

Further, the age-hardening property is promoted by subjecting to cold working after tempering.

Ti is dissolvable as solid in Cu in an amount of about 8% at high temperatures and, in addition, a notable age-hardening property which exhibits variation of the degree of solid-dissolving depending on the temperature.

The above mentioned Cu-Ni-Fe-Si-Ti alloy causes age-hardening in the form of Cu-Ni-Ti ($Ni_3Ti$), Cu-Si-Ti ($Si_3Ti_5$) or Cu-Fe-Ti ($Fe_2Ti$). This alloy has excellent characteristics as a heat-resistant electroconductive alloy and as an alloy for high-strength electric conduction.

The age-hardening type special Cu alloy is as a hexa-elemental alloy of Cu-Ni-Si-Fe-Ti-B.

Each of the metals in the above composition acts as the principal factor of hardening of the age-hardening as the phase in which the solvent metal (Cu) is dissolved as solid. Every member acts as the principal factor of hardening as an intermetallic compound or a solid solution on the basis thereof as a parent body.

SELECTION OF ELEMENTS

Cu has a tendency of decreasing the elasticity (Young's modulus) on being added with another element in general but exhibits increase of Young's modulus by the addition of Ni.

The Cu-Ni-Si-Fe-Ti-B alloy forms intermetallic compounds and has an object of being provided with high-strength and heat-resistive high-strength type electric conduction.

These alloy characteristics greatly vary depending on the amounts of Ni, Si, Fe and Ti.

This alloy can maintain its strength even on being heated continuously at a high temperature. The heat-resistance is excellent.

The age-hardening type special Cu alloy is an alloy of Cu, Ni, Fe, Si, Ti and B each of which acts as the principal factor of hardening as an intermetallic compound or a solid solution based thereon as the parent body.

The age-hardening is effected by tempering at 850° C. for 2 hours and annealing at 400° to 450° C. for 1 hour. As mentioned herein the composition of age-hardening type special Cu alloy could be fixed by the repeated experiments.

RATIO OF THE ADDED ELEMENTS

The age-hardening type special Cu alloy of the invention exhibits an adverse influence on the workability as an alloy if the content of Ni exceeds 5% as the weight ratio. On the other hand the anti-corrosive property is reduced by the addition thereof in a small amount as 0.1% or less so that addition should be made in the range of 0.1 to 5%. The range of 1 to 2.5% is preferred for addition thereof in order to impart the desirable strength and ductility to the age-hardening type special Cu alloy.

The content of added Si in an amount of 7% or more would induce deterioration of the workability and degradations of the mechanical properties and the electric conductivity. However, no effect would be obtained by the content of 0.01% or less. Addition should preferably be made in the range of 0.1 to 2.5%.

The content of added Fe in an amount of 10% or more would induce degradation of the electrical conductivity and the anti-corrosive property. On the other hand no effect is obtained by the addition of 0.01% or less. Addition should preferably be made in the range of 1 to 5%.

The content of added Ti in an amount of 7% or more would induce poor workability or degradation of the electrical conductivity. No effect would be obtained by the amount of 0.01% or less. Addition should preferably be made in the range of 0.1 to 2.5%.

Contribution to the anti-corrosive property, the hardness and the like is obtained by B. Also a notable effect is obtained as a deoxidizer for the age-hardening type special Cu alloy. The workability is adversely influenced by the addition of 1% or more. Preferably the amount should be small as 1% or less. Addition of 0.002% is more preferred.

The age-hardening type special Cu alloy is prepared by constituting the remainder of the above with Cu.

SPECIFIC EXAMPLE

A specific example of the inventive age-hardening type special Cu alloy mainly composed of Cu is shown in the following.

| Composition | |
|---|---|
| Ni | 1.3% to 2.25% |
| Si | 0.2% to 0.9% |
| Fe | 1.3% to 3.0% |
| Ti | 0.2% to 2.20% |
| B | 0.002% to 0.02% |
| Cu | the remainder |

Cu, Ni, Fe and B are firstly turned into a melt to which Ti is added and finally Si is added to deoxidize followed by melting. The melting temperature should be 1300° to 1350° C. An age-hardening type special Cu alloy with a melting point of about 1150° to 1200° C. was obtained.

The table shows the results of determination of the physical properties and mechanical properties of the age-hardening type special Cu alloy.

The table lists the properties of plates each with 2 mm of the thickness subjected to heating at 800° to 850° C. for 1 hour followed by water-quenching for tempering and then to 60% room temperature working followed by annealing at 400° C. for 1 hour. A tensile strength of 110 kg/mm$^2$ or more can be obtained by the appropriate choice of composition.

Further improvements in the tensile strength, elongation, hardness and the like may be obtained by subjecting a plate of 2 mm to a room-temperature working of 80% to 90%.

INDUSTRIAL APPLICABILITY

The age-hardening type special Cu alloy containing Cu as the main component prepared by the present invention shows improvements in the electrical conductivity, heat-conductivity and mechanical properties, particularly in the hardness and resiliency. That is, age-hardening is caused by Ni in the form of $Ni_3Ti$, by Si in the form of $Si_3Ti_5$ and by Fe in the form of $Fe_2Ti$. It was found that these alloys have an excellent character such as of the Cu-Ti-Ni alloy and Cu-Ti-Fe alloy as an alloy for heat-resistive electric conduction and of the Cu-Ti-Si alloy as an alloy for high-strength electric conduction.

The age-hardening type special Cu alloys exhibit favorable soldering property, plating property and anti-corrosive property so that they have been found to be useful widely as the material of electronic parts including relays, switches, lead-frames, connectors and the like giving an effect of improving the quality of these parts.

TABLE

| | | | | | | Physical and mechanical properties | | | | |
|---|---|---|---|---|---|---|---|---|---|---|
| Ni % | Si % | Fe % | Ti % | B % | Cu % | Tensile Strength (kg/mm$^2$) | Elongation (%) | Hardness (Vickers) | Annealing (°C.) | Tempering (hrs) |
| 2.25 | | | 0.65 | 0.002 | bal | 74.6 | 6.2 | 224 | 800~850 | 2 |
| | 0.8 | | 2.2 | 0.002 | bal | 99.0 | 5.8 | 239 | 800~850 | 2 |
| | | 2.1 | 0.9 | 0.002 | bal | 61.5 | 11.6 | 234 | 800~850 | 2 |
| 1.3 | 0.2 | 1.3 | 0.2 | 0.002 | bal | 74.5 | 10 | 224 | 800~850 | 2 |

I claim:

1. An age-hardening copper alloy consisting essentially of:
   (1) copper;
   (2) 1-2.5% by weight of Ni;
   (3) from more than 0.01% to less than 7% by weight of Si;
   (4) from more than 0.01% to less than 10% by weight of Fe;
   (5) from more than 0.01% to less than 7% by weight of Ti; and
   (6) from more than 0.001% to less than 1% by weight of B;
   wherein the amount of copper constitutes the balance of the weight of the alloy.

2. An age-hardening copper alloy as in claim 1, wherein the amount of Si is 0.1~2.5% by weight.

3. An age-hardening copper alloy as in claim 1, wherein the amount of Fe is 1~5% by weight.

4. An age-hardening copper alloy as in claim 1, wherein the amount of Ti is 0.1~2.5% by weight.

5. An age-hardening copper alloy as in claim 1, wherein the amount of B is 0.002% by weight.

6. An age-hardening copper alloy as in claim 1, wherein the proportions are:
   (1) copper: balance;
   (2) Ni: 1~2.5% by weight;
   (3) Si: 0.1~2.5% by weight;
   (4) Fe: 1~5% by weight;
   (5) Ti: 0.1~2.5% by weight; and
   (6) B: 0.002% by weight.

* * * * *